US007006775B2

(12) United States Patent
Doi et al.

(10) Patent No.: US 7,006,775 B2
(45) Date of Patent: Feb. 28, 2006

(54) IMAGE FORMING APPARATUS WITH ELECTRICALLY CONDUCTION ROTARY MEMBER FOR ELECTRICALLY CONNECTING A PLURALITY OF DEVELOPING DEVICES TO A MAIN BODY OF THE APPARATUS

(75) Inventors: Shigeo Doi, Ibaraki (JP); Seiichiro Adachi, Chiba (JP); Kenichi Tamura, Ibaraki (JP); Masashige Tamura, Ibaraki (JP); Yuhei Takei, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/924,904

(22) Filed: Aug. 25, 2004

(65) Prior Publication Data

US 2005/0047815 A1 Mar. 3, 2005

(30) Foreign Application Priority Data

Sep. 1, 2003 (JP) ..... 2003-309100

(51) Int. Cl.
*G03G 15/00* (2006.01)

(52) U.S. Cl. ..... 399/90; 399/227

(58) Field of Classification Search ..... 399/227
See application file for complete search history.

(56) References Cited

U.S. PATENT DOCUMENTS 6,650,855 B1 * 11/2003 Tajima ..... 399/227
2003/0202823 A1 10/2003 Tamura ..... 399/227

FOREIGN PATENT DOCUMENTS

JP 2001-281950 10/2001

* cited by examiner

*Primary Examiner*—Quana Grainger
(74) *Attorney, Agent, or Firm*—Fitzpatrick, Cella, Harper & Scinto

(57) ABSTRACT

Disclosed is an image forming apparatus that includes a plurality of developing devices capable of developing an electrostatic latent image on an image bearing member at a developing position, a developing device moving apparatus for holding the plurality of developing devices and selectively moving one of the plurality of developing devices to the developing position, a connecting portion disposed on an apparatus main body side for electrically connecting a developing device located at the developing position to an apparatus main body, and to-be-connected portions disposed to the plurality of developing devices, respectively and coming into contact with the connecting portion, wherein any one of the connecting portion and the to-be-connected portions comprises a rotary member which is rotated by being in contact with the other of them.

5 Claims, 14 Drawing Sheets

IMAGE FORMING APPARATUS WITH ELECTRICALLY CONDUCTION ROTARY MEMBER FOR ELECTRICALLY CONNECTING A PLURALITY OF DEVELOPING DEVICES TO A MAIN BODY OF THE APPARATUS

BACKGROUND OF THE INVENTION

1. Field of the Invention

The present invention relates to an image forming apparatus having a plurality of developing devices in correspondence to one image bearing member, in which the plurality of developing devices are switched in a method of executing development by causing the developing devices to sequentially approach the image bearing member in confrontation therewith.

2. Description of the Related Art

Heretofore, when a color image is formed, there is employed a method of developing an electrostatic image formed in response to external information using developer of a plurality of colors, sequentially forming developing agent images of the plurality of colors (toner images) on a photosensitive drum acting as an image bearing member, and overlapping the toner images of the plurality of colors on a transferring material such as a sheet or the like sequentially or at a time.

In color image forming apparatuses arranged as described above, there has been proposed and in practical use a so-called rotary development system. The rotary development system employs a rotary type developing apparatus that includes developing devices for developers (toner) of respective colors, for example, black, yellow, magenta, and cyan, mounted on rotating means (rotary), which is free to rotate, around the rotating periphery thereof and executes a developing operation by sequentially moving a necessary developing device to a developing portion that confronts the photosensitive drum acting as the image bearing member by rotating the rotary.

Incidentally, in the conventional image forming apparatus having the rotary developing apparatus arranged as described above, the respective developing devices mounted on a rotary reach a developing portion from an image forming apparatus main body in development, and a developing voltage is applied to them at the position of the developing portion. Accordingly, an electric connecting portion, that is, an image forming apparatus side connecting portion (apparatus main body side connecting portion) acting as a power supply connecting portion is disposed externally of the developing devices. In contrast, the developing devices are provided with developing device side connecting portions acting as power-to-be supplied connecting portions which are electrically connected to the apparatus main body side connecting portion. With this arrangement, when the developing devices reach the developing portion, the apparatus main body side connecting portion is connected to the developing device side connecting portions. Refer to, for example, Japanese Patent Application Laid-Open No. 2001-281950.

An image forming apparatus having three sets of developing devices 5 mounted on a rotary 8 as shown in, for example, FIG. 13 will be explained as an apparatus for realizing the above arrangement. The image forming apparatus is generally arranged as described below. That is, the developing devices 5 have protruding connecting portions 51 which protrude from the main bodies thereof as shown in FIG. 14. The main body of the image forming apparatus has a plate-shaped (or sheet-shaped) connecting portion 81 acting an apparatus main body side connecting portion. The connecting portions 81 is disposed at a position confronting the connecting portion 51 of a developing device 5 located at a developing portion P. With the above arrangement, when the rotary 8 rotates and the developing device 5 reaches the developing portion P, the protruding connecting portions 51 of the developing device 5 is abutted against the connecting portions 81 of rotary 8 and electrically connected thereto. There may be provided a plurality of positions as a contact position 58 at which the developing device side protruding connecting portions (developing device side connecting portion) 51 comes into contact with the apparatus main body side plate-shaped connecting portions (apparatus main body side connecting portions) 81. In FIG. 13, two contact positions 58 are provided for each of developing devices 5.

In this arrangement, the plate-shaped connecting portion 81 is provided with a spring property and secured in an image forming apparatus main body, for example, it is disposed to a cabinet by which the rotary 8 is supported. In the image forming apparatus of FIG. 13, bearings 8*a*, which are disposed on both the sides the rotating shaft of the rotary 8, are composed of plate-shaped (or sheet-shaped) members extending from the rotating shaft of the rotary 8. The plate-shaped members are disposed on both the sides of the developing devices 5 in the vicinity thereof. The conductive connecting portion 81 is attached to one of the bearing plate (or sheet) 8*a* by being, for example, bonded thereto or embedded therein. The connecting portion 81 is disposed at a portion confronting one side of a developing device 5 located at the developing portion P with its conducting portion facing the developing device 5.

As shown in FIG. 14, the protruding connecting portion 51 of each developing device 5 protrudes from the one side thereof, and the conducting portion at the extreme end the connecting portion 51 comes into contact with the connecting portion 81, which is disposed to one of the bearing plates 8*a* adjacent to both the sides of the developing device 5 in confrontation therewith, at the developing portion P.

As described above, the connecting portions 51 of the developing devices 5 are abutted against the connecting portion 81 disposed to the bearing plate 8*a* of the rotary 8 at the developing portion P. When the developing devices 5 are switched by rotating the rotary 8, the connecting portions 51 are in sliding contact with the connecting portion 81. Accordingly, in an image forming apparatus that can form an image at high speed, the rotating speed of the rotary 8 is also increased, and thus is difficult to guarantee the durability of the connecting portions 51 and 81.

As a countermeasure for the above drawback, many examples reduce the moving speed of the connecting portions 51 on the developing device 5 side by disposing the contact positions 58 of the developing device side connecting portions 51 and the apparatus main body side connecting portion 81 at positions as nearer to the center of rotation X of the rotary 8 as possible as shown in FIG. 13.

Further, springs 82 are interposed between the apparatus main body side connecting portions 81 and the bearing plate 8*a* as shown in FIG. 14 to maintain a state that the connecting portion 51 is securely abutted against the connecting portion 81 at the contact positions 58, thereby the connecting portion 81 is pressed against the connecting portion 51.

Note that, the connecting portions 51 and 81 are disposed in the image forming apparatus main body such that the conductive portions thereof do not come into contact with the members other than them so as to prevent an electric leakage.

In the arrangement of the conventional connecting portion described above, however, since the image forming speed is in a contradictory relationship to the durability of the connecting portions 51 and 81, an increase in the rotating speed of the rotary 8 increases a speed at which the connecting portion 51 is in sliding contact with the connecting portion 81, from which an unavoidable problem arises in grinding and breakage of the connecting portions 51 and 81.

Further, when the connecting portion 51 is abutted against the connecting portions 81, the connecting portion 51 is slightly separated from the connecting portions 81 inevitably by the repulsion caused when they collide against each other. Thus, the electric leakage may occur when a developing voltage is applied at the time. In an image forming apparatus in which the rotating speed of the rotary 8 is relatively slow, an effective countermeasure can be relatively simply employed to overcome the above drawback by increasing the force of the springs 82 of the apparatus main body side connecting portion disposed externally of the rotary 8. In an image forming apparatus, in which the rotating speed of the rotary 8 is 150 mm/sec in the vicinity of the contact positions 58, however, a more severe sliding condition is imposed on the connecting portions 51 and 81, from which problems relating to the durability thereof arise inevitably in many cases.

Further, restrictions are naturally imposed also on an arrangement in which an image is formed by reducing the moving speed of the developing device side connecting portions 51 by disposing the contact positions 58 in the vicinity of the center X of the rotary 8 to improve the sliding condition of the connecting portions described above. Since the area of the abutting surface of the apparatus main body side connecting portion 81 is reduced with respect to, for example, a necessary movement angle, it is difficult for the connecting portion 81 to maintain a stable abutting state against the developing device side connecting portion 51 in the above arrangement.

SUMMARY OF THE INVENTION

An object of the present invention is to provide an image forming apparatus using developing devices that can move to an image bearing member, the apparatus being able to stabilize an electrically connected state of electrically connecting portions on a developing device side and on a main body side.

An image forming apparatus for achieving the above object includes:

a plurality of developing devices capable of developing an electrostatic latent image on an image bearing member at a developing position;

a developing device moving apparatus for holding the plurality of developing devices and selectively moving one of the plurality of developing devices to the developing position;

a connecting portion disposed on an apparatus main body side for electrically connecting a developing device located at the developing position to an apparatus main body; and to-be-connected portions disposed to the plurality of developing devices, respectively and coming into contact with the connecting portion, wherein any one of the connecting portion and the to-be-connected portions comprises a rotary member which is rotated by being in contact with the other of them.

DETAILED DESCRIPTION OF THE EMBODIMENTS

Image forming apparatuses according to the present invention will be explained below in detail with reference to the drawings.

(Embodiment 1)

Figure 1:
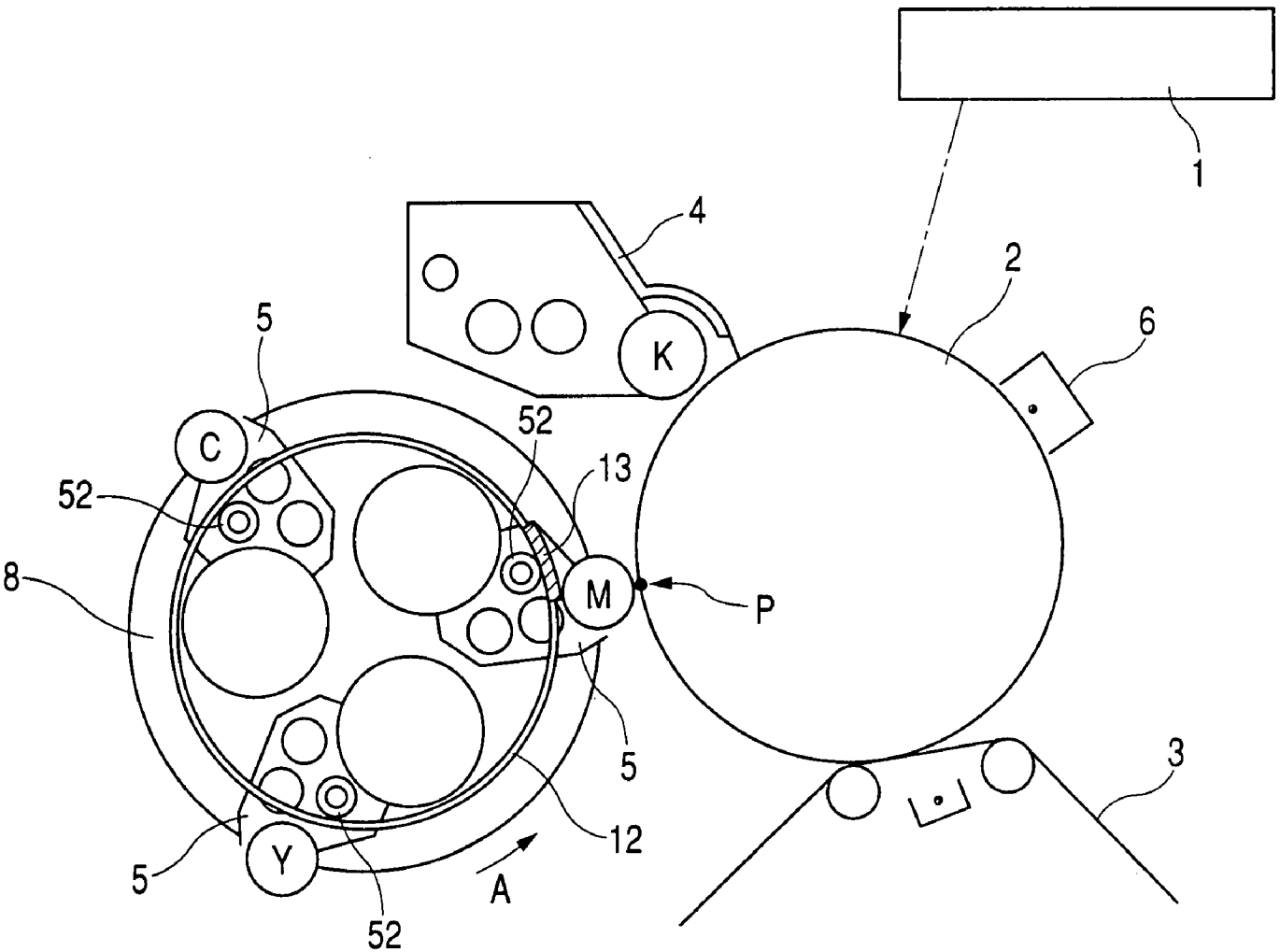
FIG. 1 is a schematic arrangement view showing an image forming apparatus of an embodiment 1 of according to the present invention.

First, an image forming apparatus will be explained in its entirety with reference to FIG. 1. FIG. 1 is a schematic sectional view of an electronic photography type image forming apparatus as an example of the image forming apparatus.

The image forming apparatus includes a photosensitive drum 2 acting as an image bearing member. The surface of the photosensitive drum 2 is uniformly charged by charging means 6, and an electrostatic image is formed on the surface of the photosensitive drum 2 by changing the surface potential of the uniformly charged photosensitive drum 2 using a laser scanner 1 acting as a light source based on image information sent from a not shown reader scanner, personal computer, or the like.

First, the electrostatic image formed on the photosensitive drum 2 is developed by stationary developing apparatus 4, thereby a developer image (toner image) is formed on the surface of the photosensitive drum 2.

The toner image is transferred onto an intermediate transfer belt 3.

Thereafter, development is executed using one of a plurality (three sets in this case) of developing devices 5 mounted on rotating means (rotary) 8, and a developer image (toner image) is formed on the surface of the photosensitive drum 2.

The toner image is transferred onto the intermediate transfer belt 3.

The other developing devices 5 are sequentially moved to a developing portion P that is a position confronting the photosensitive drum 2 by rotating the rotary 8. Then, this operation is sequentially repeated so that a full color toner image is formed on the intermediate transfer belt 3 by overlapping the toner images formed by the stationary developing apparatus 4 and the respective developing devices 5.

The full color image formed on the intermediate transfer belt 3 is transferred onto a transferring material (sheet) that is fed by a feeding apparatus and permanently fixed thereon by a not shown fixing apparatus. Thereafter, the sheet is discharged to the outside of the main body of the image forming apparatus, thereby a series of an image forming operation is finished.

Note that the overall arrangement of the image forming apparatus is not limited to that shown above. That is, an electrostatic recording system, a system for directly forming the full color toner image onto the transferring material without using the intermediate transfer belt 3, a system that employs an intermediate transfer drum or the like, and the like may be also employed, and the arrangement of the image forming apparatus other than the rotary type developing apparatus may be appropriately determined.

As shown in FIG. 1, the plurality (here, the three sets) of the developing devices 5 are mounted on the rotating means (rotary) 8. A necessary developing device 5 is selectively set to the developing portion P where the developing device 5 confronts the photosensitive drum 2 by rotating the rotary 8 in a predetermined direction A, and the development is executed to form a toner image on the photosensitive drum 2. Although the three sets of the color toner developing devices 5 are mounted on the rotary 8 in the image forming apparatus of the embodiment 1, the number of the developing devices 5 is not particularly limited. Further, the arrangement of the rotary 8 and a method of mounting the developing devices 5 on the rotary 8 are also not particularly limited as long as the developing devices 5 can be sequentially moved to the developing portion P by a rotating motion.

Figure 13:
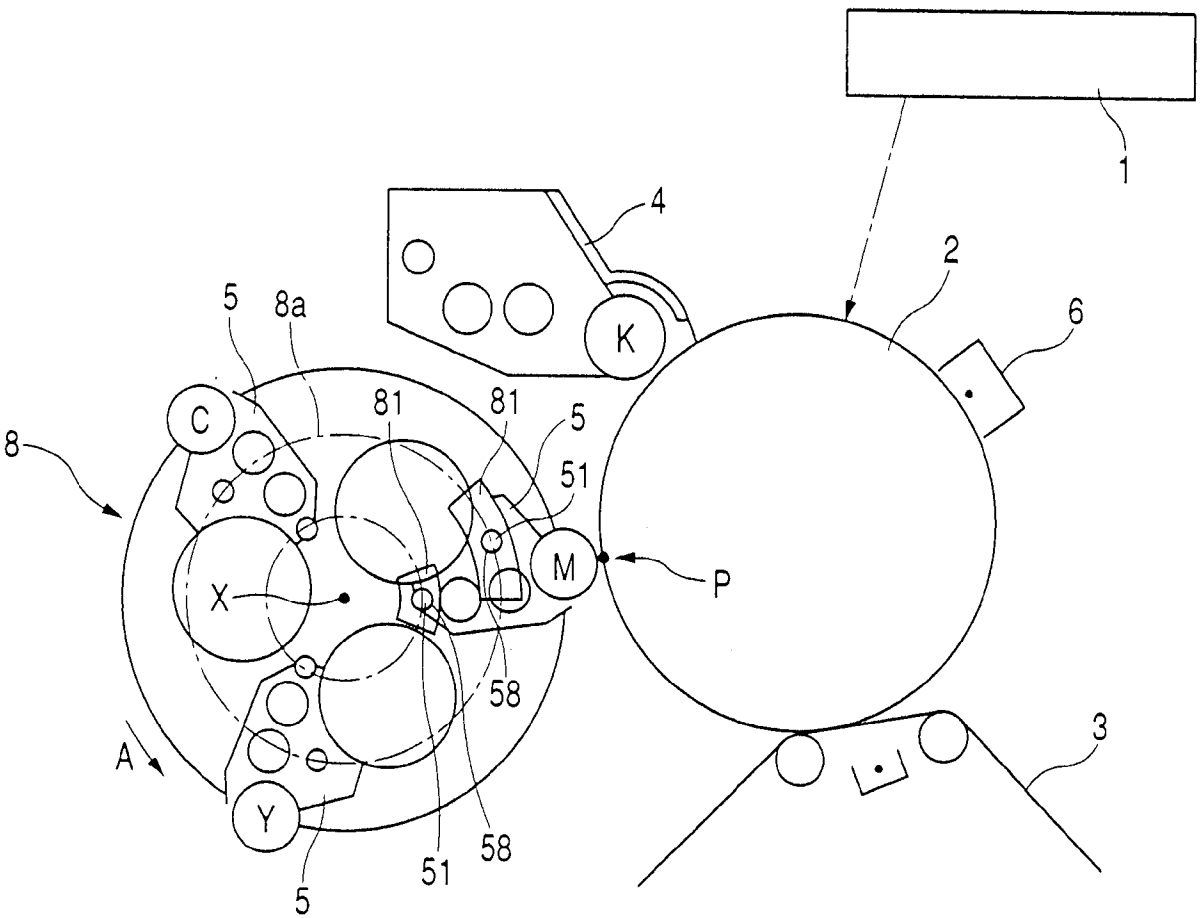
FIG. 13 PRIOR ART
FIG. 13 is a schematic arrangement view showing an embodiment of a conventional image forming apparatus.
Figure 14:
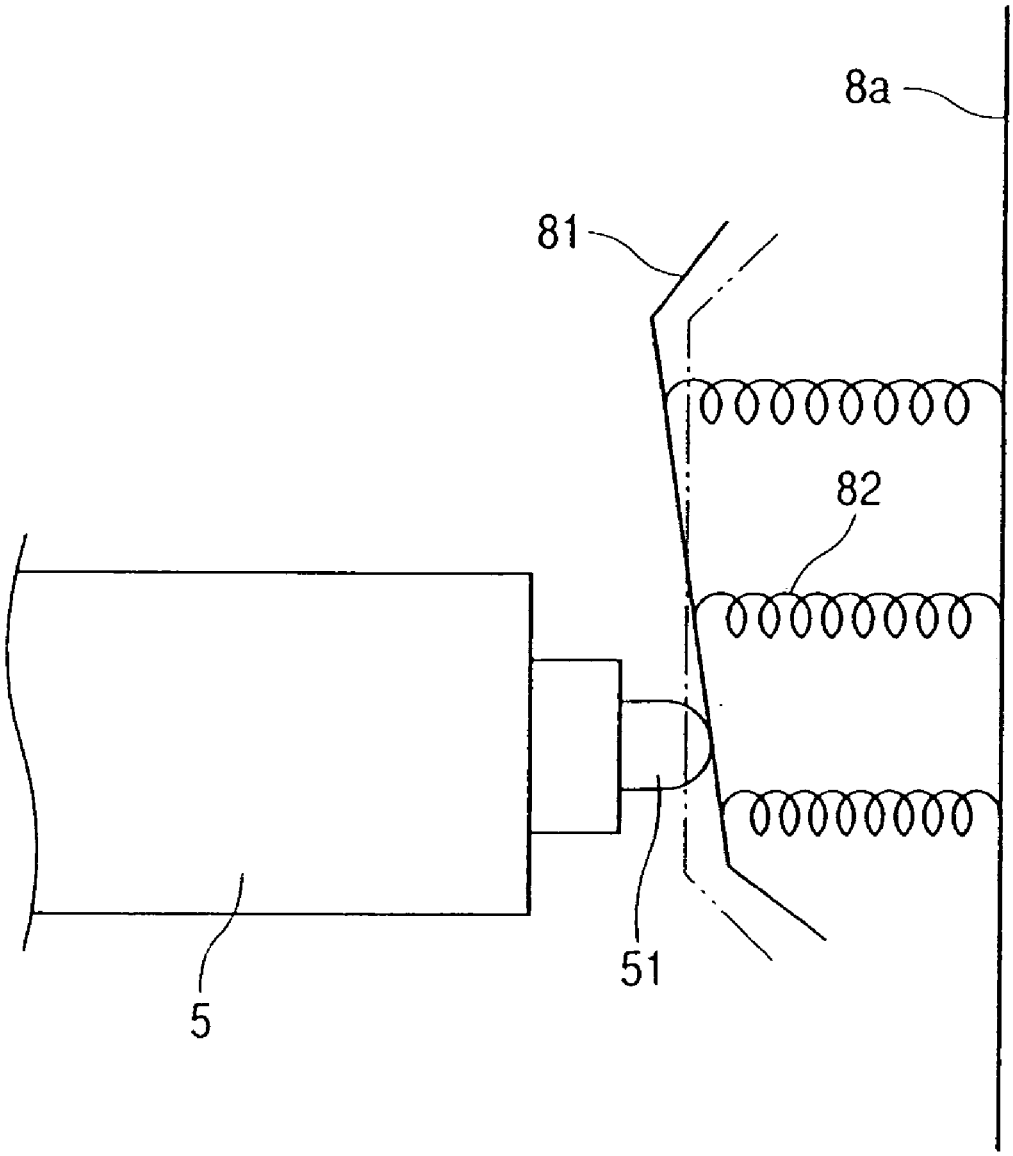
FIG. 14 PRIOR ART
FIG. 14 is an explanatory view showing an example of conventional connecting portions on a main body side and developing device side, and a positional relationship thereof.

As explained in the conventional example in detail using FIGS. 13 and 14, the image forming apparatus, which switches a developing device 5 located at the developing portion P by the rotary system, includes the image forming apparatus main body side connecting portion (apparatus main body side connecting portion), which acts as a power supply connecting portion for supplying a developing voltage to the developing devices 5 from the outside thereof, and the developing device side connecting portions acting as a power-to-be-supplied connecting portion. The apparatus main body side connecting portion is composed of the plate-shaped connecting portions 81 having a spring property 82 and fixedly disposed at positions confronting a side of the developing device 5 located at the developing portion P. The developing device side connecting portion is composed of the projecting connecting portions 51 projecting from a side of each of the respective developing devices 5. In the above arrangement, when the developing device 5 reaches the developing portion P, the projecting connecting portions 51 are abutted against the plate-shaped connecting portions 81. Accordingly, when the developing devices 5 are switched, the connecting portions 51 slide on the connecting portions 81, which is often disadvantageous in that a problem of durability arises and the abutting state of the connecting portions 51 and 81 is made unstable due to the effect of dents traces caused by an impact in abutment.

To cope with the above problems, in the image forming apparatus of the present invention, the respective developing devices 5 held by the rotary 8 are provided with rotary connecting portions (roller connecting portions) 52 acting as the developing device side connecting portion, respectively, so that the developing voltage is applied therefrom in development.

Further, a connecting portion support member (hereinafter, referred to as "ring") 12 is disposed to an image forming apparatus main body side so as to overlap the sides of the developing devices 5, the ring 12 being formed in an approximately circular shape, and in a ring shape in the embodiment and disposed coaxially with the rotating shaft of the rotary 8. The rotating outer peripheries of the roller connecting portions 52, which are free to rotate (to rotate on their shafts), are abutted against the inner peripheral portion of the ring 12 at all times. It is preferable that the roller connecting portions 52 be pressed in the outer peripheral direction of the ring 12 so that the abutting state is kept at all times. However, the ring 12 may be pressed in its inner peripheral direction to the roller connecting portions 52 or both the roller connecting portions 52 and the ring 12 are pressed so that they are in contact with each other. The roller connecting portions 52 move along the ring 12 in association with the developing devices 5 moved by the rotary 8 while rolling on the inner peripheral portion of the ring 12 with the outer peripheries thereof in abutment with the inner peripheral portion of the ring 12.

Further, as an arrangement for applying the developing voltage to the developing devices 5, a portion of the inner peripheral portion of the ring 12 is arranged as a connecting portion 13 that acts as the apparatus main body side connecting portion to which the developing voltage is supplied from a main body power supply. The connecting portion 13 is disposed in an angle region that includes a connecting region when a developing device is located at the developing portion P in terms of an angle from the center of the ring 12 so that the developing voltage can be applied only to the developing device 5 that reaches the developing portion P. Further, the connecting portion 13 is arranged as a portion of a circle formed by the ring 12 and forms the same circle together with the inner peripheral portion of the ring 12 other than the connecting portion 13. Therefore, the abutting portion of the connecting portion 13 abutted against a roller connecting portion 52 is located tangentially with respect to the inner periphery of the ring 12, and thus almost no gap occurs when the roller connecting portions 52 pass through the boundaries between the connecting portion 13 and the portion other than the connecting portion 13. Since the connecting portion 13 is not a rotary member, it is arranged as a non-rotating connecting portion.

Note that productivity can be enhanced by setting a period of time from a time at which a developing devices 5 leaves the developing portion P to a time at which a next developing device 5 reaches the developing portion P, that is, a rotating period of time of the rotary 8, which is necessary to switch the developing devices 5, to a time less than a passing period of time of a non-image region, that is, a region between toner images on the intermediate transfer belt 3.

Since the intermediate transfer belt 3 has a high rotating speed in a high speed machine having a high image forming speed, the switching speed of the rotary 8 cannot help being set to a high speed to reduce the switching period of time of the developing devices 5 in accordance with the high image forming speed.

This will be explained as to an example of actual image forming apparatuses. In an image forming apparatus, in which the intermediate transfer belt 3 has a length capable of forming tone images corresponding to two A4-size sheets and productivity when a full color image is formed is 15 sheets/min in terms of an A4-size sheet, the switching period of time of the developing devices 5 must be set to 300 msec or less, and when the outside diameter of the rotary 8 is set to 120 mm, the rotary 8 has a considerably high outer peripheral speed of about 400 mm/sec although it depends on the size of the image forming apparatus main body.

Accordingly, when the connecting portions are caused to slide on each other by the rotation of the rotary as in the conventional machine, it is difficult to avoid problems relating to durability and stability such as grinding of the connecting portions caused by the sliding wear thereof, deterioration of the surfaces of the connecting portions and an unstably abutting state thereof due to vibration, dents, and the like in abutment, a power leakage phenomenon accompanying them, and the like.

In the image forming apparatus of the present invention, however, the roller connecting portions 52 explained above are rotated by the rotation of rotary 8 when development is switched as a series of an image forming operation to thereby avoid the problems of the grinding of the connecting portions caused by the sliding wear thereof, the deterioration of the surfaces of the connecting portions and the unstably abutting state thereof due to vibration, dents, and the like in abutment, the power leakage phenomenon accompanying them, and the like can be avoided.

That is, since the connecting portions on the developing device 5 side are formed in the roller shape, the grinding and the like of the connecting portions due to the friction wear therebetween can be minimized. Further, since the connecting portion 13 is formed as the portion of the circle of the ring 12, there can be prevented disadvantages such as the deterioration of the connecting portions due to the dents and vibration caused by the collision of the connecting portions 52 and 13 on the developing device side and apparatus main body, the power leakage caused by that the connecting portions are temporarily separated from each other by the vibration thereof. Accordingly, the arrangement of the present invention can cope with a further increase in an image forming speed which is expected hereinafter.

Further, the region of the connecting portion 13 of the ring 12 in the embodiment 1 will be explained using FIGS. 2 and 3.

Figure 2:
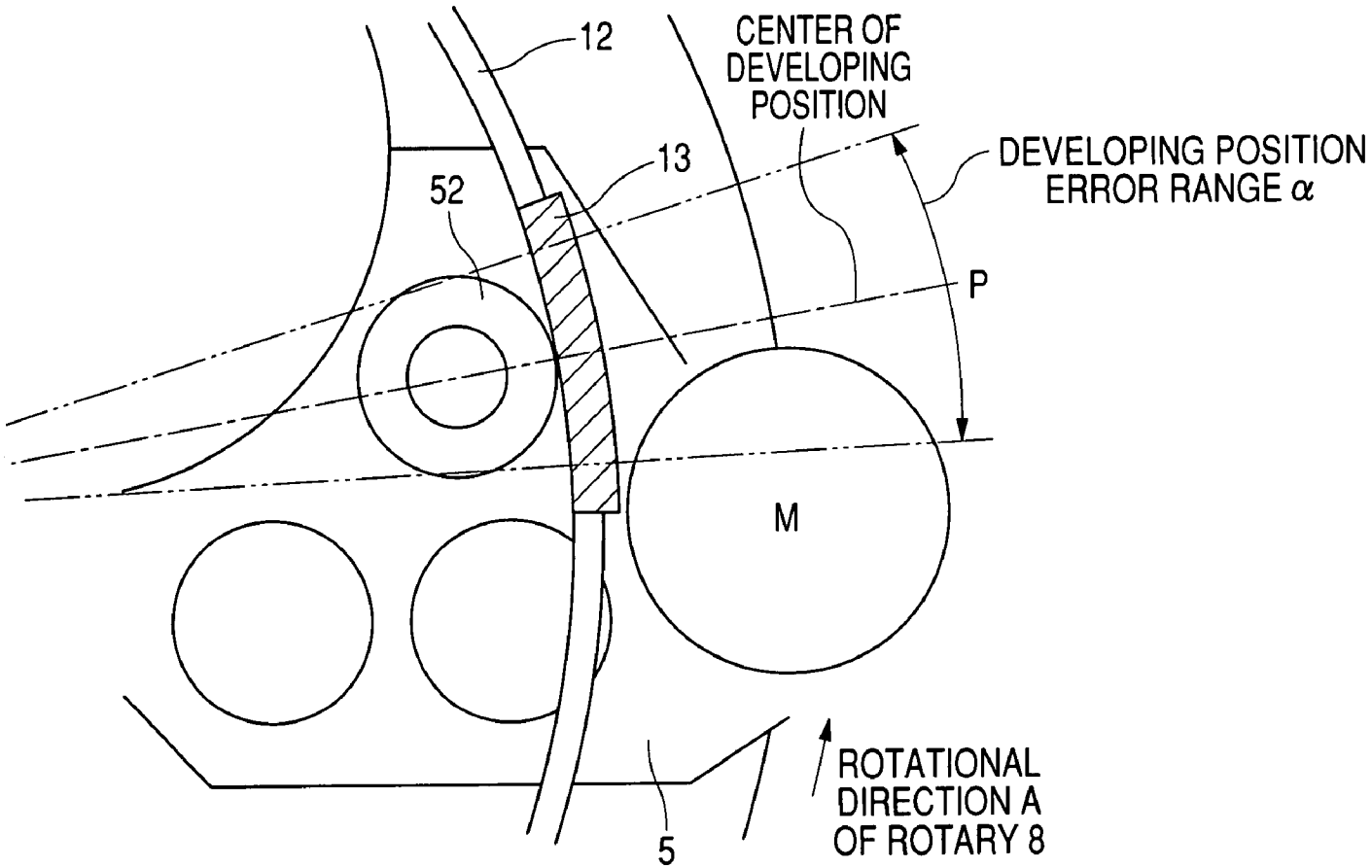
FIG. 2 is an explanatory view showing an example of connecting portions on a main body side and developing device side, and a positional relationship thereof.

When the developing voltage is applied after a developing device 5 stops at the developing portion P in a state that the rotary 8 has a sufficiently fast rotating speed with respect to the switching period of time of the developing devices 5 in the image forming apparatus including the rotary 8, any problem does not particularly arise when the angle region of the connecting portion 13 in the ring 12 is set to an angle region a that corresponds to a stop position error of the developing device 5 as shown in FIG. 2.

Figure 3:
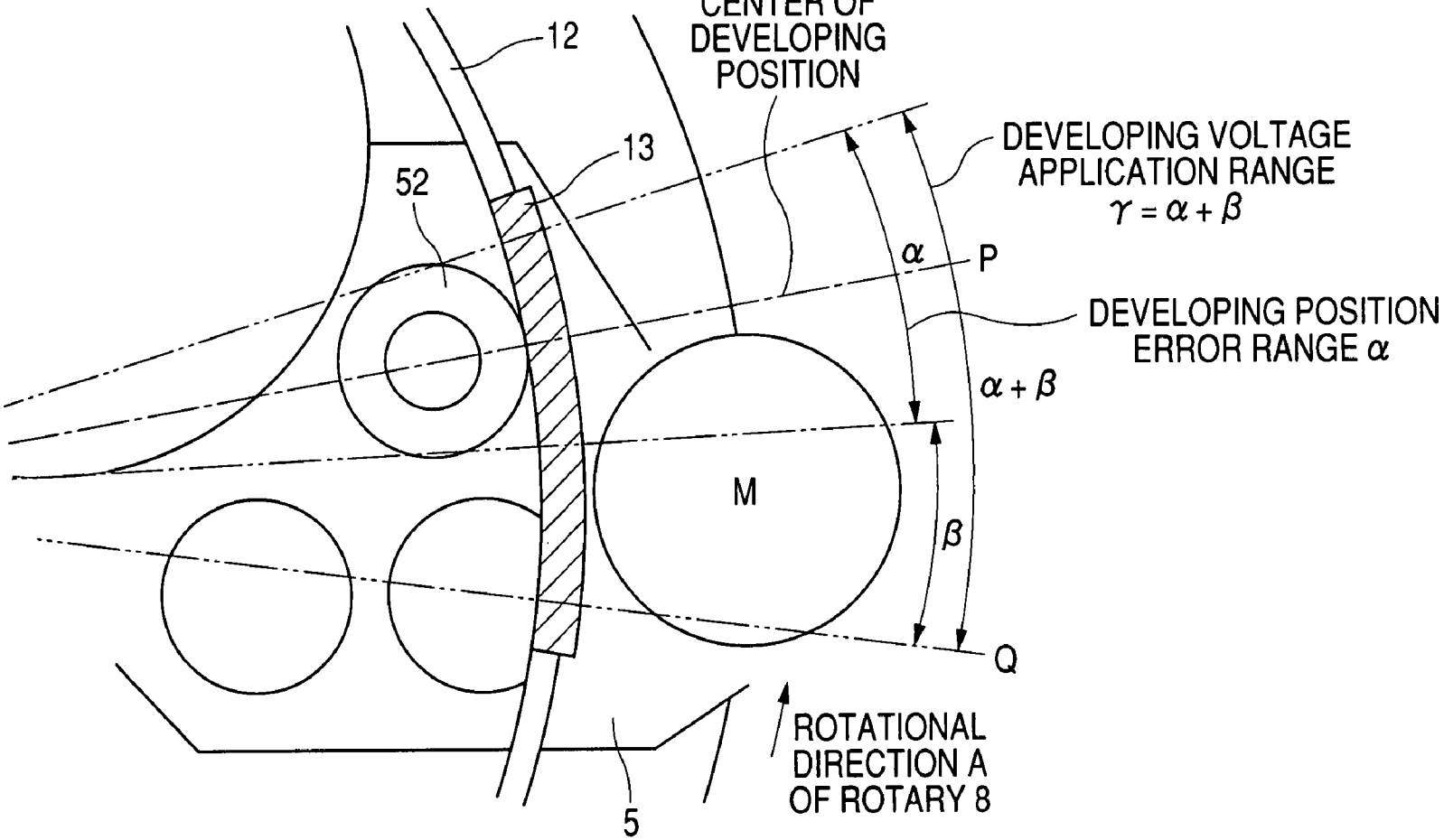
FIG. 3 is an explanatory view showing another example of connecting portions on a main body side and developing device side, and a positional relationship thereof.

However, in an arrangement that a very severe relationship is established between the switching period of time of the developing devices 5 and the rotating speed of the rotary 8, that is, in an arrangement that the developing voltage is applied just before the rotary 8 stops so that development is executed in a state that the applied voltage is stabilized and the developers in the developing devices 5 are preferably made to a development possible state, a larger developing voltage application range $\gamma=(\alpha+\beta)$ must be set to the connecting portion 13 so as to cover a developing voltage application start point Q which is a position before the developing device 5 reaches the developing portion P just before the rotary 8 stops to the developing portion P as shown in FIG. 3. In this arrangement, the abutting region of the connecting portion 13 abutted against a roller connecting portion 52 is widened by an angle region $\beta$ in a direction opposite to the rotating direction of the rotary 8.

The roller connecting portions 52 is preferably composed of a material having a small rotation resistance to minimize sliding between the projecting connecting portions 52 and the connecting portion 13 which is caused when they are slipped as the rotary 8 rotates, and the like. In the image forming apparatus of the embodiment 1, a bearing into which conductive grease is poured is used as the material of the roller connecting portions 52. However, the material is not particularly limited to the bearing, and the same effect can be obtained by any conductive roller-shaped arrangement.

Further, although the material of the ring 12 is not particularly limited as long as it is a non-conductive or insulating material and excellent in a sliding property, molded members such as POM, PBT, PPS and the like are preferably used. Although the material constituting the connecting portion 13 is not particularly limited as long as it is excellent in conductivity and also in a sliding property, metal members, for example, a copper plate (or sheet), steel plate (or sheet), stainless steel plate (or sheet), and the like are preferably used.

The same effect can be also obtained even in an arrangement that the roller connecting portions 52 are disposed to the rotary 8 in place of that they are disposed to the main bodies of the developing devices 5 attached to the rotary 8, and a connecting portion 52 supplies the developing voltage to a corresponding developing device 5 through a not shown conductive member while maintaining the relationship between the roller connecting portions 52 and the ring 12 in the state described above.

Figure 4:
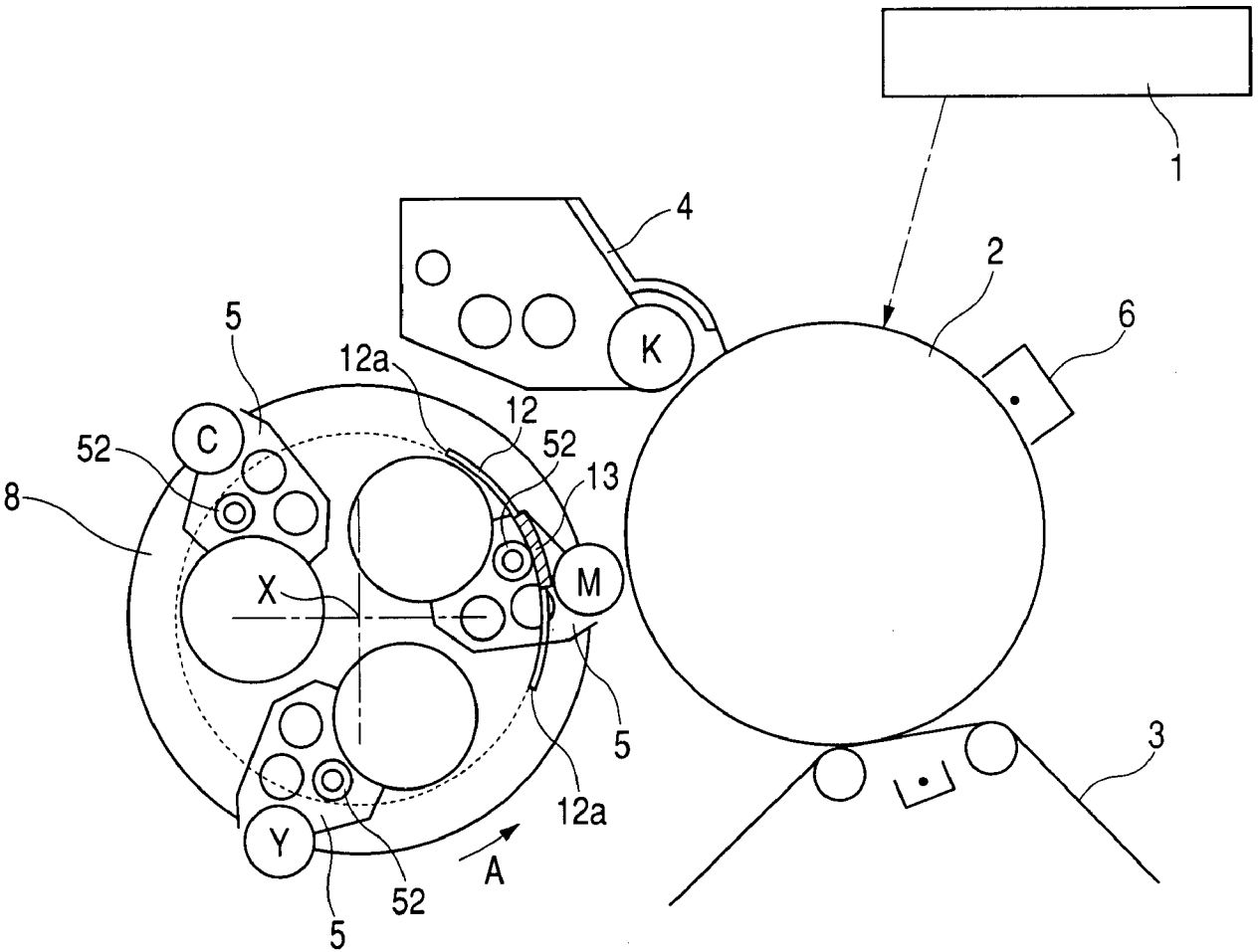
FIG. 4 is a schematic arrangement view showing another example of the image forming apparatus according to the present invention.

Further, in the image forming apparatus shown in FIG. 1, the ring 12 is formed in the closed ring shape. However, the same effect can be obtained even if it is composed of an arc-shaped member (hereinafter, referred to as "arc member") 12 which is concentric with the rotating shaft of the rotary 8 as shown in FIG. 4. In this case, however, it is preferable that the shape of the ends 12*a* of the arc member 12 against which the roller connecting portions 52 are abutted first be formed in a taper shape, in other words, in a guide shape as shown in FIG. 4 to minimize the occurrence of shock in abutment.

(Embodiment 2)

The detailed explanation of an image forming apparatus of an embodiment 2 is omitted because the overall arrangement thereof is the same as that of the embodiment 1 except the arrangement of electric connecting portions between developing devices 5 and an image forming apparatus main body. Accordingly, only the characteristic arrangement of the embodiment 2 that is different from the embodiment 1 will be explained using FIG. 5.

Figure 5:
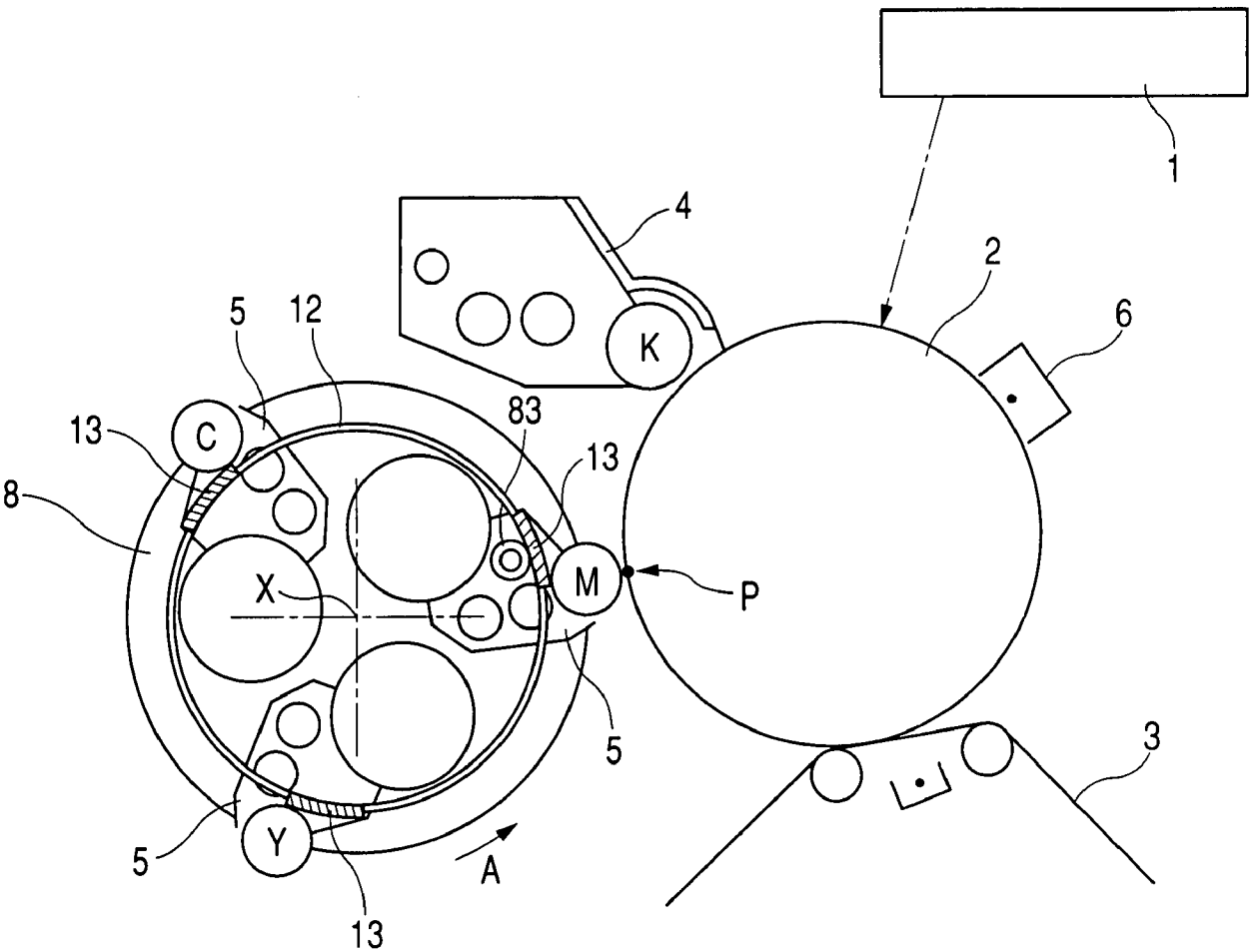
FIG. 5 is a schematic arrangement view showing an image forming apparatus of an embodiment 2 according to the present invention.

The image forming apparatus of the second embodiment shown in FIG. 5 is characterized in that a ring 12 is provided with a rotary 8, and when the rotary 8 is in rotation, the ring 12 is also rotated together with the rotary 8 in a direction A. The ring 12 have connecting portions 13 disposed on the inner peripheral surface thereof so that they correspond to developing devices 5 held by the rotary 8, respectively. In contrast, a roller connecting portion 83 is disposed on an apparatus main body side in an angle region to which a developing device 5 is connected when it is located at the position of a developing portion P, the roller connecting portion 83 being always abutted against the inner peripheral portion of the ring 12 while being rotated (rotated on its shaft) by the rotation of the rotary 8, that is, by the rotation of the ring 12.

The roller connecting portion 83 is disposed to a rotary bearing 8*a* or the like and fixed beside the rotary 8 and has a rotating shaft disposed in parallel with the rotating shaft of the rotary 8.

The connecting portions 13 are arranged as portions of a circle formed by the ring 12 and forms the same circle in conformity with the portions of the ring 12 other than the connecting portions 13, and thus the abutting portion of a connecting portion 13 abutted against the roller connecting portion 83 is located tangentially with respect to the inner periphery of the ring 12. Accordingly, when the boundaries between the connecting portions 13 and the portions of the ring 12 other than the connecting portions 13 pass through the abutting portions of the roller connecting portion 83 abutted against the connecting portions 13 as the ring 12 rotates, almost no step is formed to the roller connecting portion 83.

With the above arrangement, the connecting portionmember 13 of a developing device 5, which reaches the developing portion P at certain time, is abutted against the roller connecting portion 83 on the apparatus main body side.

The roller connecting portion 83 is pressed against the ring 12 by a not shown arrangement so that it is abutted against the inner peripheral portion of the ring 12 at all times likewise the embodiment 1. However, it is a matter of course that the ring 12 material may be pressed against the roller connecting portion 83 or both of them may be pressed in a direction where they come into contact with each other.

Figure 6:
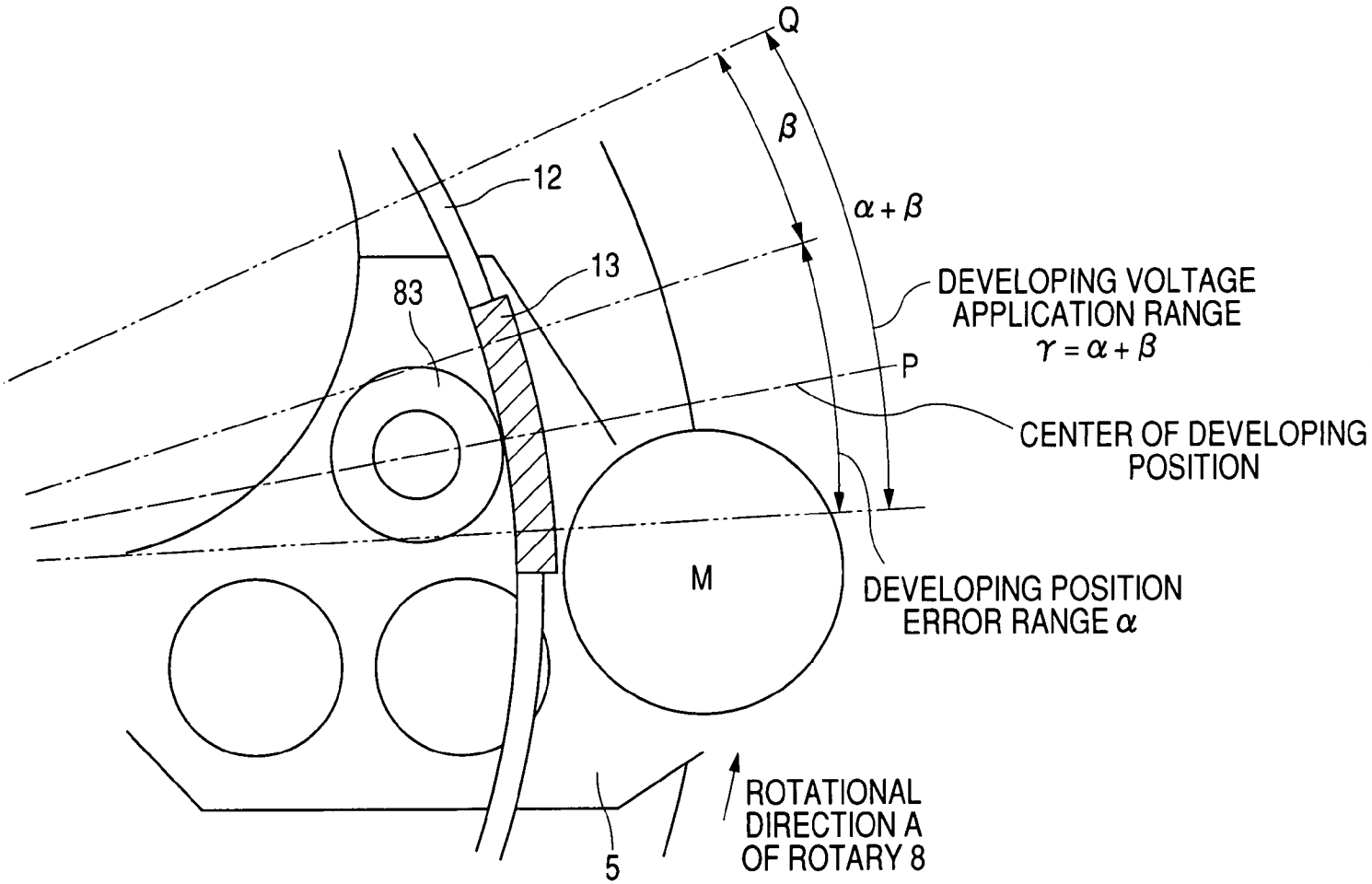
FIG. 6 is an explanatory view showing still another example of connecting portions on a main body side and developing device side, and a positional relationship thereof.

In an arrangement that the developing voltage is applied after a developing device 5 stops at the developing portion P likewise the embodiment 1, the abutting region in which a connecting portions 13 is abutted against the roller connecting portion 83 is set to an angle region $\alpha$ that corresponds to a stop position error of the developing device 5 in a state that the developing device 5 stops at the developing portion P. Whereas, in an arrangement that the developing voltage is applied just before the rotary 8 stops, a larger developing voltage application range $\gamma=(\alpha+\beta)$ must be set to the connecting portion 13 so as to cover a developing voltage application start point Q which is a position before the developing device 5 reaches the developing portion P just before the rotary 8 stops to the developing portion P In the embodiment 2, however, the angle region is widened in a direction opposite to the direction shown in FIG. 3, that is, in the rotating direction A of the rotary 8 as shown in FIG. 6 because the ring 12 rotates and the roller connecting portion 83 is located at a stationary position.

As described above, in the embodiment 2, the developing device side connecting portions are arranged as the non-rotating connecting portions, and the apparatus main body side connecting portion is arranged as the rotating member connecting portion, in contrast that, in the embodiment 1, the developing device side connecting portions are arranged as the roller-shaped rotating member connecting portions, and the apparatus main body side connecting portion is arranged as the non-rotating connecting portion composed of a portion of the ring.

Note that the materials of the roller connecting portion 83, the ring 12, and the connecting portions 13 are the same as those of the roller connecting portions 52 and the like explained in the embodiment 1.

The same effect as that of the embodiment 1 can be also obtained in the second arrangement. That is, when development is switched, the rotation of the rotary 8 is always followed by the rotation of the roller connecting portion 83, thereby the problems of the grinding of the connecting portion caused by the sliding wear thereof, the deterioration of the surfaces of the connecting portions and the unstably abutting state thereof due to vibration, dents, and the like in abutment, the power leakage phenomenon accompanying them, and the like can be avoided, and thus an increase in speed of the image forming apparatus can be coped with thereby.

(Embodiment 3)

The detailed explanation of an image forming apparatus of an embodiment 3 is omitted because the overall arrangement thereof is the same as that of the embodiment 1 except the arrangement of electric connecting portions between developing devices 5 and an image forming apparatus main body. Accordingly, only the characteristic arrangement of the embodiment 2 that is different from the embodiment 1 will be explained using FIG. 7.

The roller connecting portions 52, which are located on the developing device side in the embodiment 1, and the roller connecting portion 83, which are located on the image forming apparatus main body side in the embodiment 2, are disposed inwardly of the ring 12, the rotating shafts thereof are in parallel with the rotating shaft of the rotary 8, and they rotate along the inner periphery of the ring 12. However, as a third embodiment of the present invention, it is also possible to employ such an arrangement that the rotating shafts of roller connecting portions are disposed in a direction vertical to the rotating shaft of a rotary 8, and the roller connecting portions come into contact with the peripheral surface formed by the ring 12 from a vertical direction and roll along the peripheral surface of the ring 12.

Figure 7:
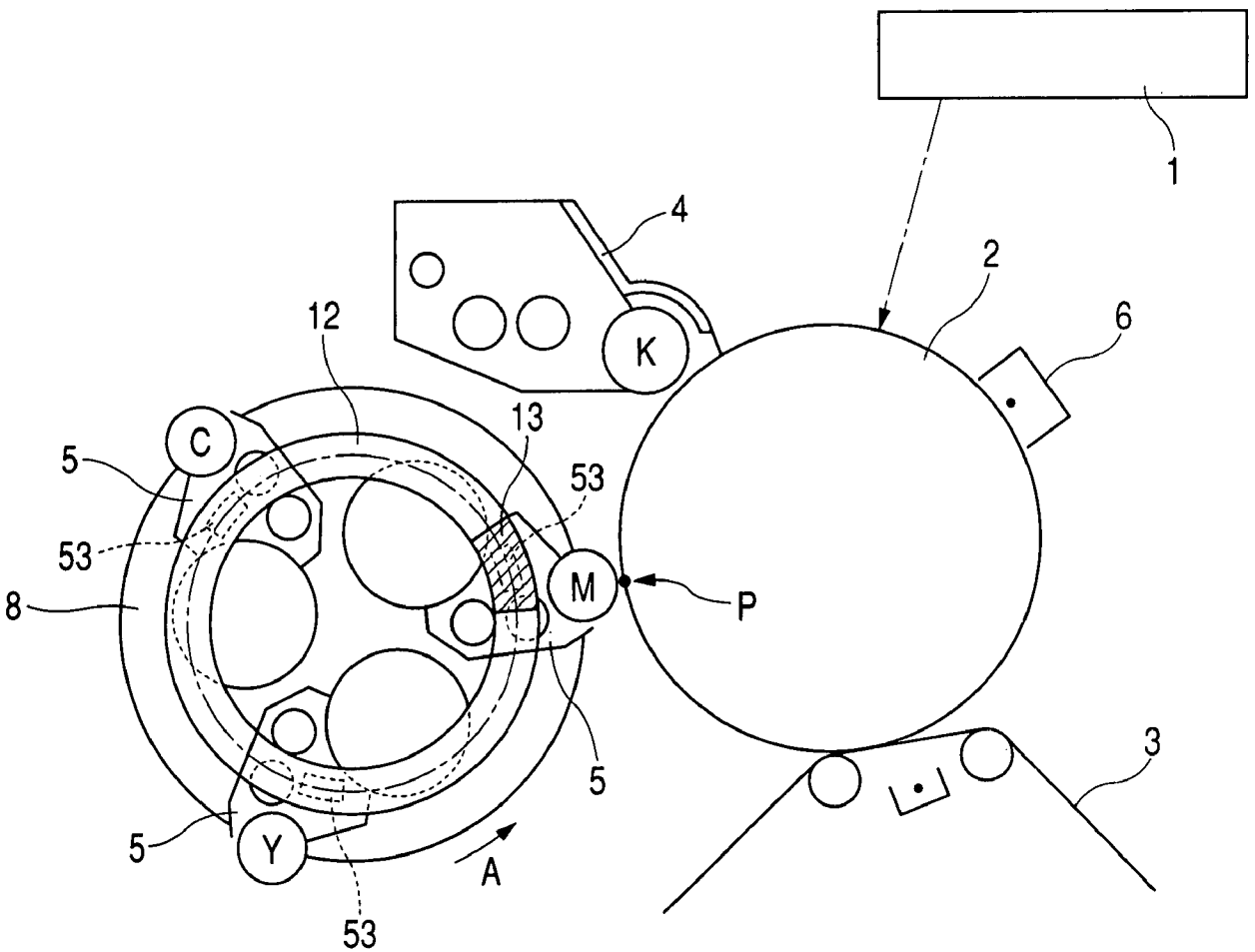
FIG. 7 is a schematic arrangement view of an image forming apparatus of an embodiment 3 according to the present invention.
Figure 8:
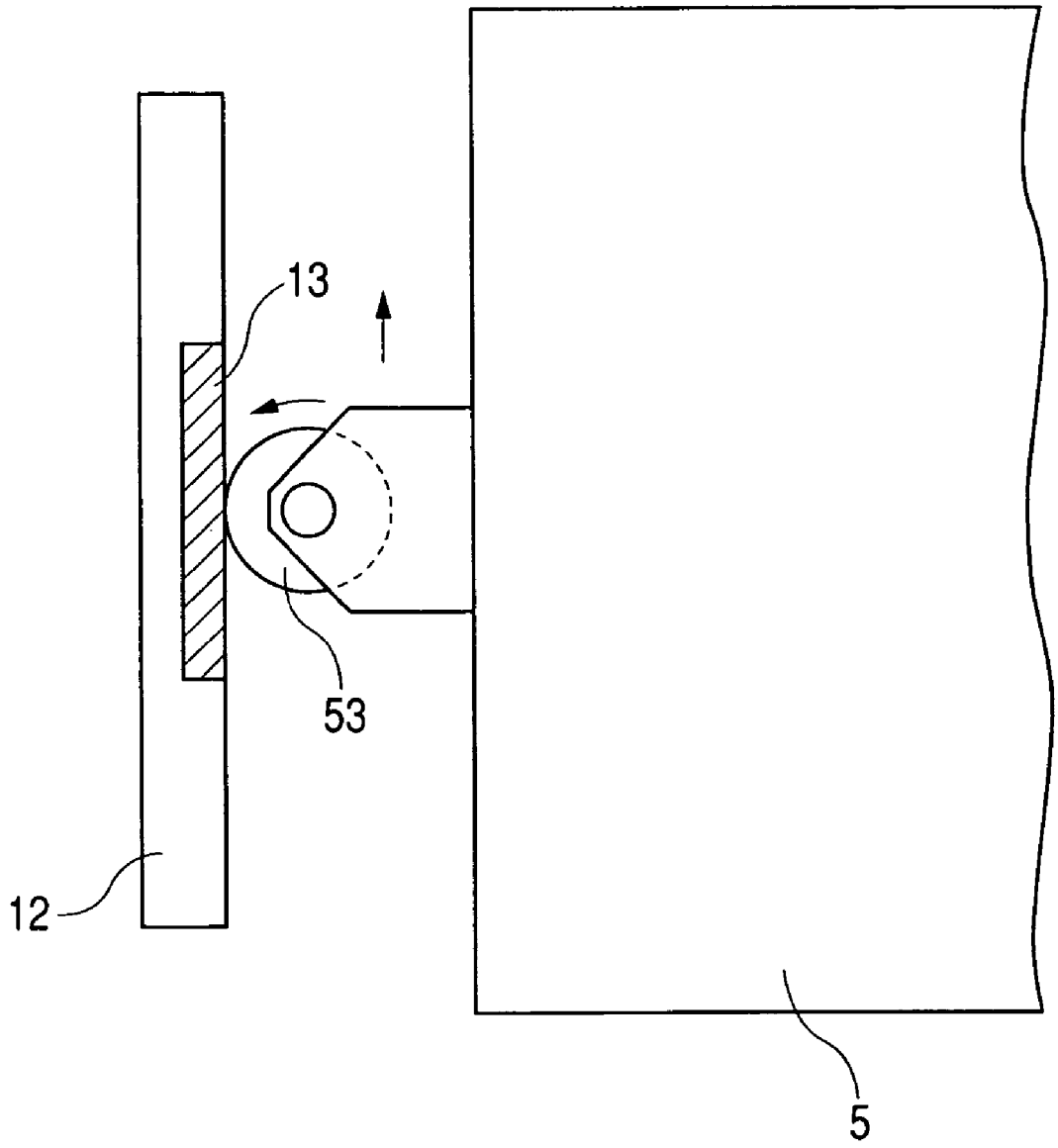
FIG. 8 is an explanatory view showing yet still another example of connecting portions on a main body side and developing device side, and a positional relationship thereof.

As shown in FIG. 7, the image forming apparatus is characterized in that the roller connecting portions 53, which vertically come into contact with the peripheral surface of the ring 12 are disposed on a developing device side and an apparatus main body side connecting portion 13 is arranged as a portion of the stationary ring 12. The apparatus main body side connecting portion 13 disposed to face a developing device 5 of the ring 12 in a direction vertical to the rotating shaft of the rotary 8 in an angle region including a connecting region to which the developing device 5 is connected when it is located at the position of the developing portion P. As shown in FIG. 8, the rotating shaft of each roller connecting portion 53 disposed on a side of the developing device 5 is vertical to the rotating shaft of the rotary 8, and the roller connecting portion 53 rolls around the ring 12 in association with the rotation of the rotary 8 with the rotating outer periphery (which rotates on its axis) thereof in vertical contact with the ring 12.

Since the connecting portion 13 acting as the apparatus main body side connecting portion on the ring 12 side is flush with the surface of the ring 12, almost no step is formed when the roller connecting portions 53 pass through the boundaries between the connecting portion 13 of the ring 12 and the portions other than the connecting portion 13 of the ring 12.

Since the abutting portion of the connecting portion 13 abutted against the roller connecting portion 53 is set similarly to the abutting portion of the connecting portion 13 abutted against the connecting portion 52 in the embodiment 1, explanation as to how the abutting portion is set is omitted.

To preferably maintain the abutting state between the connecting portions 53 and and the connecting portion 13, it is preferable to press one of the portions to the other portion or to set both of them in a pressed state. A simplest arrangement in design is to press the ring 12 against the roller connecting portions 53. As a point to be kept in mind in this case resides in that when the three developing devices 5 exist in the rotary 8 as in the image forming apparatus of this embodiment, the ring member 12 must be provided with a degree of freedom in correspondence to the rotary 8 when it rotates because the ring member 12 must come into contact with all the roller connecting portions 53 disposed to the respective developing devices 5.

Note that the same effect can be obtained even if the roller connecting portions 53 are disposed directly to the developing devices 5 similarly to the embodiment 1 or disposed to the rotary 8 itself through conductive members.

Figure 9:
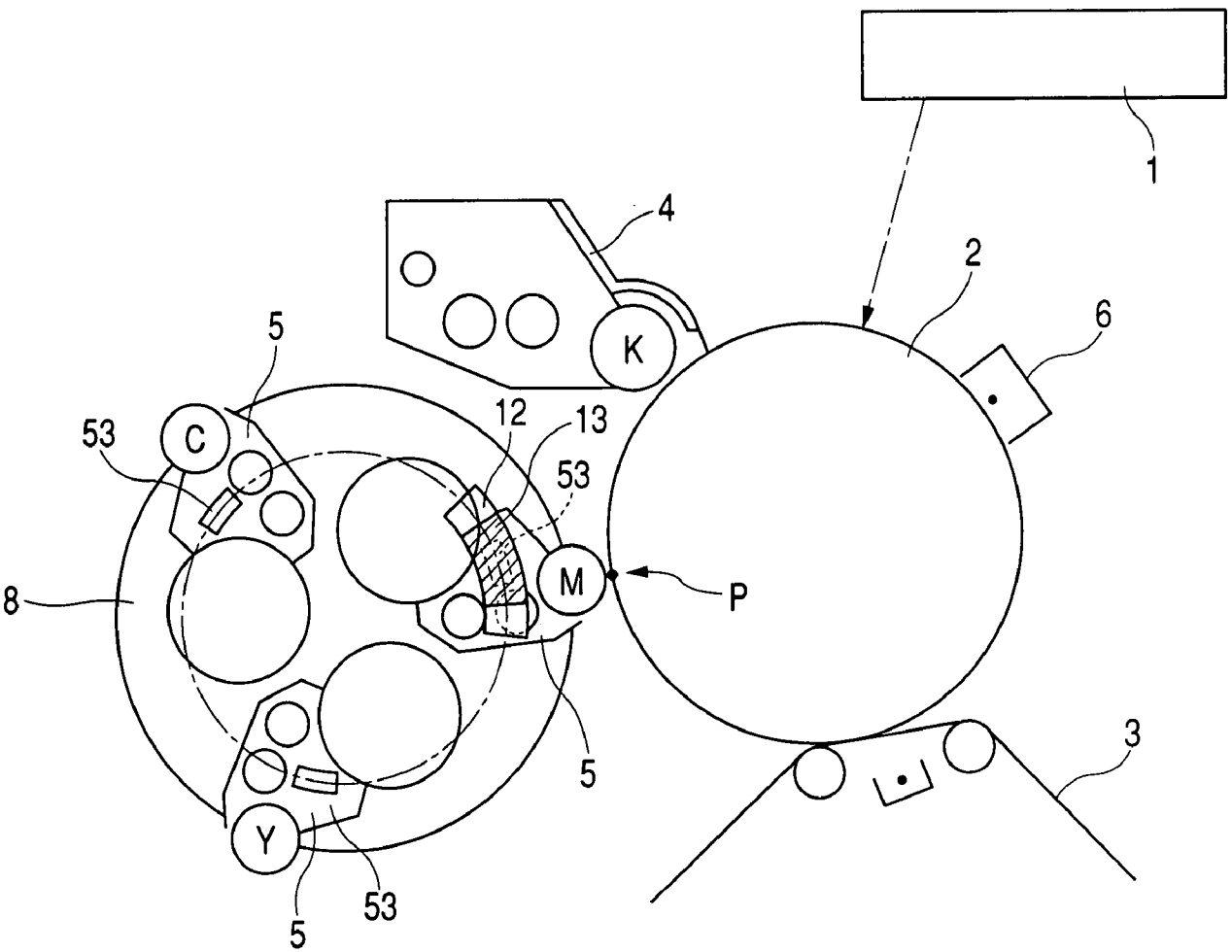
FIG. 9 is a schematic arrangement view showing another example of the image forming apparatus according to the present invention.

The ring 12 is not limited to a ring shape as shown in FIG. 7, and no problem arises even if it is formed in a perfect disc shape. Further, no problem arises even if it is formed in an arc shape as shown in FIG. 9 and disposed only in the vicinity of the connecting portion 13.

Note that the materials of the roller connecting portion 53, the ring 12, and the connecting portions 13 are the same as those of the roller connecting portions 52 and the like explained in the embodiment 1.

The same effect as that of the embodiment 1 can be also obtained in the third arrangement. That is, when development is switched, the rotation of the rotary 8 is always followed by the rotation of the roller connecting portion 53, thereby the problems of the grinding of the connecting portion caused by the sliding wear thereof, the deterioration of the surfaces of the connecting portions and the unstably abutting state thereof due to vibration, dents, and the like in abutment, the power leakage phenomenon accompanying them, and the like can be avoided, and thus an increase in speed of the image forming apparatus can be coped with thereby.

(Embodiment 4)

The detailed explanation of an image forming apparatus of an embodiment 4 is omitted because the overall arrangement thereof is the same as that of the embodiment 1 except the arrangement of electric connecting portions between developing devices 5 and an image forming apparatus main body. Accordingly, only the characteristic arrangement of the embodiment 4 that is different from the embodiment 1 will be explained using FIG. 10.

Also in the embodiment 4, the rotating shaft of a roller connecting portion is disposed in a direction vertical to the rotating shaft of a rotary 8, and the roller connecting portion comes into contact with the peripheral surface formed by a ring 12 from a vertical direction and rolls along the peripheral surface of the ring 12 likewise the embodiment 3.

Figure 10:
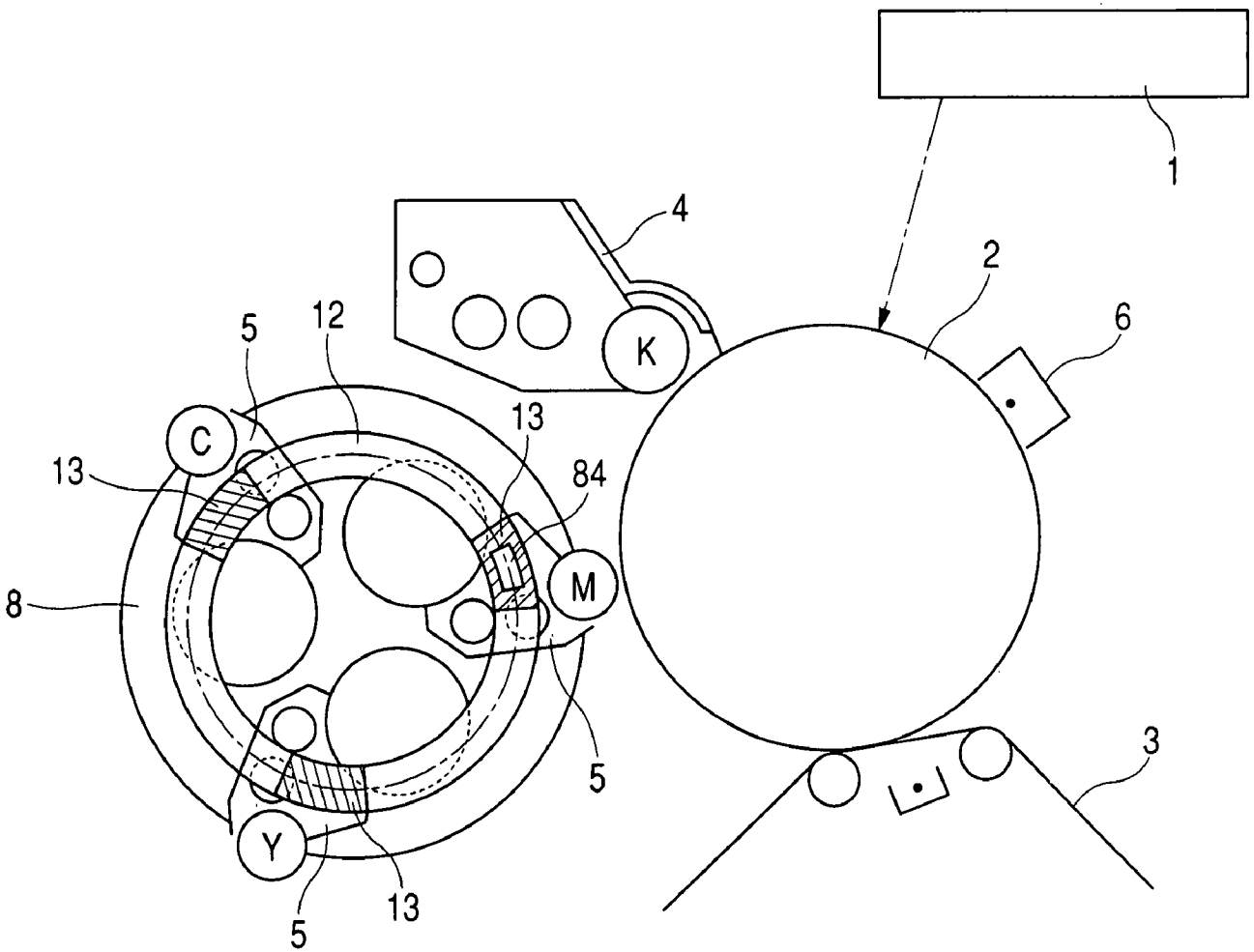
FIG. 10 is a schematic arrangement view showing an image forming apparatus of an embodiment 4 according to the present invention.

The image forming apparatus shown in FIG. 10 is characterized in that the roller connecting portion 84 having the rotating shaft vertical to the ring 12 is provided as a main body side connecting portion in place of the roller connecting portion 83 of the second embodiment, which is arranged such that the ring 12 is provided with the rotary 8, when the rotary 8 rotates, the ring 12 also rotates together with the rotary 8, the connecting portions 13 are provided with the ring 12 in correspondence to the respective developing devices 5 held by the rotary 8, and the roller connecting portion 83 on the main body side is disposed to the ring 12 at the angle position of the developing portion P and rotated (rotated on its axis) by the rotation of the rotary 8, that is, by the rotation of the ring 12 in contact therewith at all times.

Figure 11:
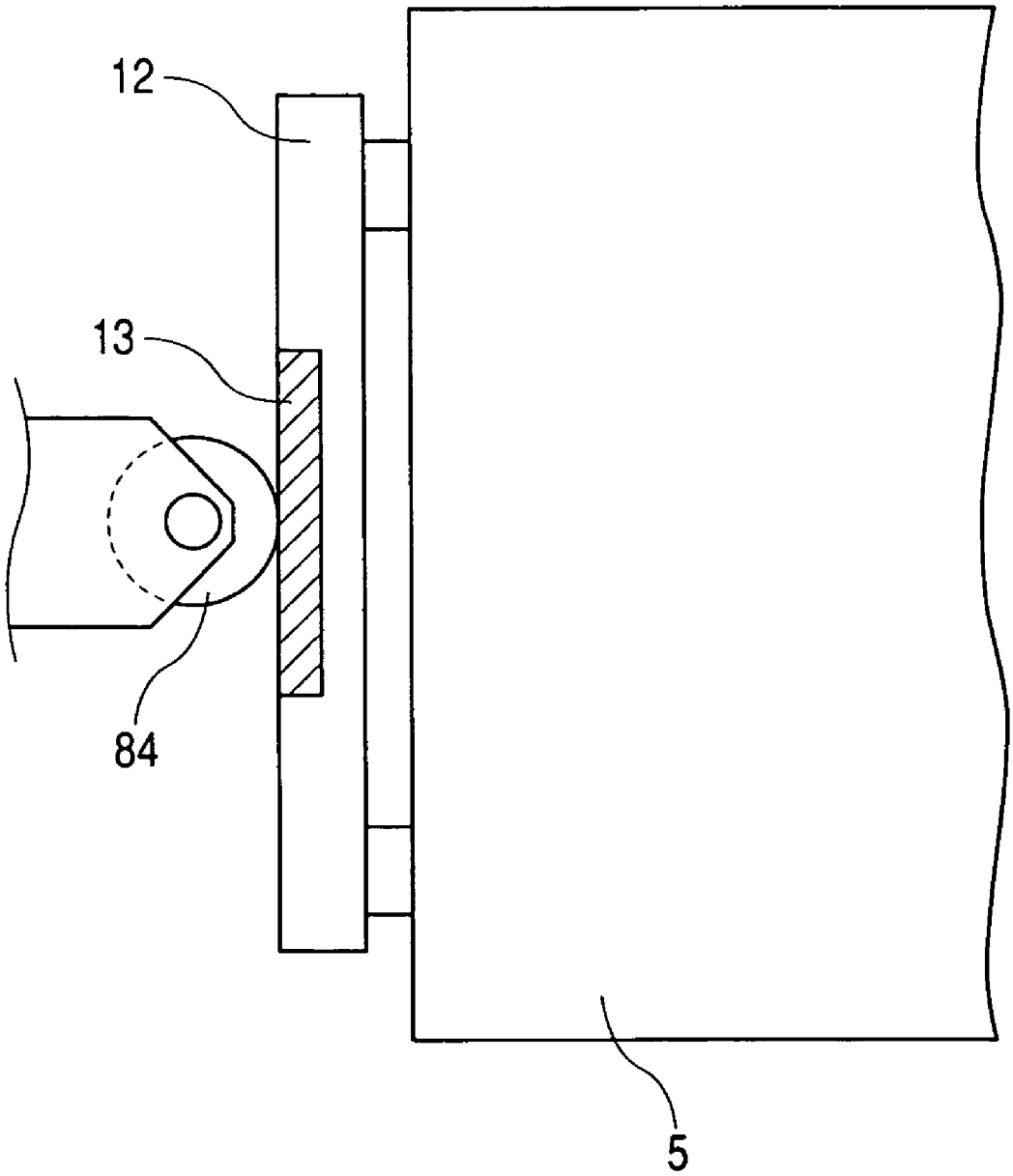
FIG. 11 is an explanatory view showing a further example of connecting portions on a main body side and developing device side, and a positional relationship thereof.

In the fourth embodiment, developing device side connecting portions 13, which are composed of portions of the ring 12 and are disposed on sides of developing devices 5 are arranged vertically with respect to the rotating shaft of the roller connecting portion 84, and the roller connecting portion 84 causes the rotating outer periphery (which rotates on its axis) thereof to come into contact with the ring 12 in a vertical direction, thereby the roller connecting portion 84 is rotated by the rotation of the ring 12 which is rotated by the rotary 8 as shown in FIG. 11.

The connecting portions 13 acting as developing device side connecting portions and disposed on the ring member 12 side are flush with the surface of the ring 12. Therefore, almost no step is formed when the boundaries between the connecting portions 13 of the ring 12 and the portions other than the connecting portion 13 pass through the roller connecting portion 84.

Since the ring 12 is rotated by the rotation of the rotary 8 also in the embodiment 4, the abutting region of a connecting portion 13 abutted against the roller connecting portions 52 is set similarly to the setting of the abutting region of a connecting portion 13 abutted against the roller connecting portion 83 of the embodiment 2, and thus explanation of the setting thereof is omitted.

To preferably maintain the abutting state between the connecting portion 84 and the connecting portions 13, it is preferable to press one of the portions to the other portion or to set both of them in a pressed state.

Figure 12:
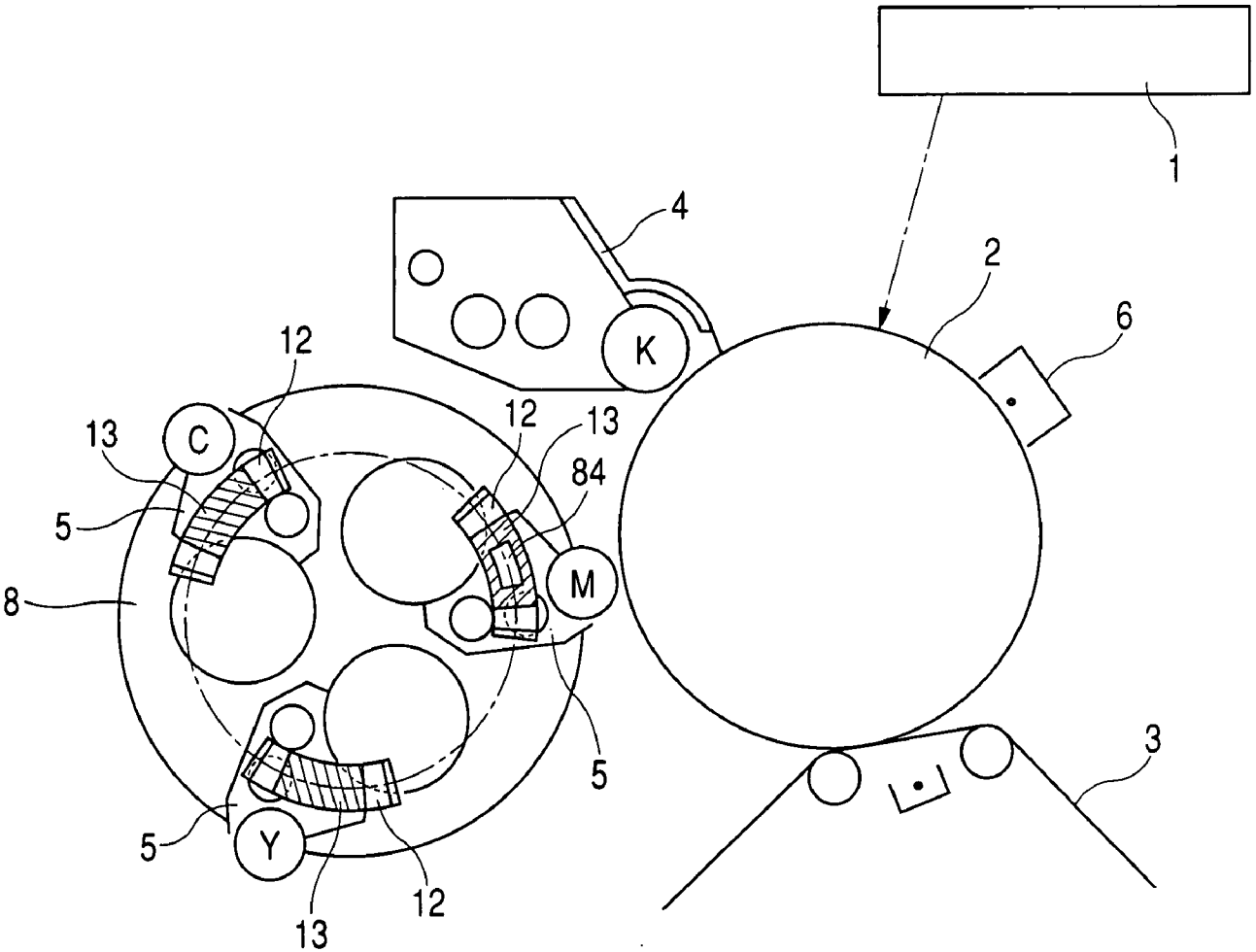
FIG. 12 is a schematic arrangement view showing another example of the image forming apparatus according to the present invention.

The ring member 12 is not limited to a ring shape as shown in FIG. 10, and no problem arises even if it is formed in a perfect disc shape. Further, no problem arises even if it is formed in an arc shape as shown in FIG. 12 and disposed only in the vicinity of the connecting portions 13.

Note that the materials of the roller connecting portion 84, the ring 12, and the connecting portions 13 are the same as those of the roller connecting portions 52 and the like explained in the embodiment 1. The roller connecting portion 84 is disposed to, for example, a rotary bearing 8*a* or the like which is secured to the image forming apparatus so as to face a side of a developing device 5.

The same effect as that of the embodiment 1 can be also obtained in the fourth arrangement. That is, when development is switched, the rotation of the rotary 8 is always followed by the rotation of the roller connecting portion 84, thereby the problems of the grinding of the connecting portion caused by the sliding wear thereof, the deterioration of the surfaces of the connecting portions and the unstably abutting state thereof due to vibration, dents, and the like in abutment, the power leakage phenomenon accompanying them, and the like can be avoided, and thus an increase in speed of the image forming apparatus can be coped with thereby.

The scope of the invention is not restricted only to the sizes, materials, and shapes of the components of the image forming apparatus described above, the relative positions where the components are arranged, and the like unless specifically described.

This application claims priority from Japanese Patent Application No. 2003-309100 filed Sep. 1, 2003, which is hereby incorporated by reference herein.

What is claimed is:

1. An image forming apparatus comprising:

a plurality of developing devices capable of developing an electrostatic image on an image bearing member at a developing position;

a developing device moving apparatus for holding the plurality of developing devices and selectively moving one of the plurality of developing devices to the developing position;

a connecting portion disposed on an apparatus main body for electrically connecting a developing device located at the developing position to the apparatus main body; and to-be-connected portions disposed to the plurality of developing devices, respectively, and electrically connected by coming into contact with the connecting portion, wherein any one of the connecting portion and the to-be-connected portions has an electrically conductive rotary member which is rotated by being in contact with the other of them when moving the developing device toward the developing portion, and wherein the rotary member is electrically connected by coming into contact with the other of them in a state that the rotary member stops, when the developing device located at the developing position executes a developing operation.

2. An image forming apparatus according to claim 1, comprising:

a connecting portion support member for supporting the connecting portion and guiding a relative movement between the to-be-connected portions and the connecting portion, wherein substantially no step exists in boundaries between the connecting portion and the connecting portion support member.

3. An image forming apparatus according to claim 1, comprising:

a to-be-connected portion support member for supporting the to-be-connected portions and guiding a relative movement between the connecting portion and the to-be-connected portions, wherein substantially no step exists in boundaries between the to-be-connected portions and the to-be-connected portion support member.

4. An image forming apparatus according to claim 2, wherein the developing device moving apparatus rotates the plurality of developing devices and moves them to the developing portion, and the to-be-connected portions are abutted against the connecting portion support member at all times.

5. An image forming apparatus according to claim 3, wherein the developing device moving apparatus rotates the plurality of developing devices and moves them to the developing portion, and the connecting portion is abutted against the to-be-connected portion support member at all times.

* * * * *

UNITED STATES PATENT AND TRADEMARK OFFICE

CERTIFICATE OF CORRECTION

PATENT NO. : 7,006,775 B2
APPLICATION NO. : 10/924904
DATED : February 28, 2006
INVENTOR(S) : Shigeo Doi et al.

It is certified that error appears in the above-identified patent and that said Letters Patent is hereby corrected as shown below:

ON THE TITLE PAGE:

IN THE TITLE, ITEM (54):

"CONDUCTION" should read --CONDUCTING--.

COLUMN 1:

Line 2, "CONDUCTION" should read --CONDUCTING--.

COLUMN 2:

Line 2, "acting" should read --acting as--;
Line 3, "is" should read --are--;
Line 5, "above" should read --above-described--;
Line 8, "is" should read --are--;
Line 13, "comes" should read --come--;
Line 22, "the sides" should read --sides of--;
Line 29, “the” (first occurrence) should be deleted;
Line 55, "nearer" should read --near as possible--;
Line 56, "as possible" should be deleted;
Line 65, "not" should read --not otherwise--; and
Line 66, "other than them" should be deleted.

COLUMN 3:

Line 18, "above" should read --above-described--.

UNITED STATES PATENT AND TRADEMARK OFFICE

CERTIFICATE OF CORRECTION

PATENT NO. : 7,006,775 B2
APPLICATION NO. : 10/924904
DATED : February 28, 2006
INVENTOR(S) : Shigeo Doi et al.

It is certified that error appears in the above-identified patent and that said Letters Patent is hereby corrected as shown below:

COLUMN 6:

Line 4, "above" should read --above-described--;
Line 12, "traces" should be deleted; and
Line 63, "non-rotating" should read --nonrotating--.

COLUMN 8:

Line 57, "taper" should read --tapered--.

COLUMN 10:

Line 6, "non-rotating" should read --nonrotating--.

Signed and Sealed this

Third Day of October, 2006

JON W. DUDAS
*Director of the United States Patent and Trademark Office*